US005392106A

United States Patent [19]

Bigenwald et al.

[11] Patent Number: 5,392,106

[45] Date of Patent: Feb. 21, 1995

[54] AUTOMATIC SHEET DECURLER APPARATUS

[75] Inventors: John J. Bigenwald; Robert A. Bohli, both of Rochester, N.Y.

[73] Assignee: Xerox Corporation, Stamford, Conn.

[21] Appl. No.: 84,719

[22] Filed: Jun. 25, 1993

[51] Int. Cl.[6] ..... G03G 21/00; G03G 15/00

[52] U.S. Cl. ..... 355/309; 162/270; 162/271; 271/188; 271/209; 271/272; 355/282; 355/285; 355/308

[58] Field of Search ..... 355/203, 204, 208, 282, 355/285, 289, 290, 308, 309, 315; 162/270, 271; 271/188, 209, 272

[56] References Cited

U.S. PATENT DOCUMENTS

| | | | |
|---|---|---|---|
| 4,475,896 | 10/1984 | Bains | 162/271 X |
| 4,591,259 | 5/1986 | Kuo et al. | 162/271 X |
| 5,066,984 | 11/1991 | Coombs | 355/309 |
| 5,144,385 | 9/1992 | Tani | 355/309 |
| 5,153,662 | 10/1992 | Foos | 355/309 |
| 5,183,454 | 2/1993 | Kurosawa et al. | 162/271 X |
| 5,201,514 | 4/1993 | Rebres | 271/188 |
| 5,202,737 | 4/1993 | Hollar | 355/308 |
| 5,287,157 | 2/1994 | Miyazato et al. | 355/309 |

*Primary Examiner*—A. T. Grimley
*Assistant Examiner*—Sandra L. Brasé
*Attorney, Agent, or Firm*—Oliff & Berridge

[57] ABSTRACT

A decurling apparatus and method to decurl a substrate in a xerography machine. The invention combines a decurling apparatus having a penetration roller with a small diameter penetrating into a belt. The penetration roller is adjustable and as it pushes into the belt, more decurling of a copy sheet will occur. A controller determines the amount of decurling that is necessary and sends an electrical signal to a driver which operates the penetration roller. The penetration roller is either pressed into or away from the decurling belt. A cam shaft is turned by a motor to cause the cams to move the penetration roller. Although the controller stores the information on the cam location, a home sensor is required to indicate home position. The cam shaft is returned to home position before adjusting the penetration roller to a new level of decurling.

19 Claims, 5 Drawing Sheets

AUTOMATIC SHEET DECURLER APPARATUS

BACKGROUND OF THE INVENTION

1. Field of the Invention

This invention relates to improvements in the operation of a sheet decurler in a photocopying machine. More particularly, this invention has a decurler apparatus which automatically adjusts the tension in the decurler for adjusting the amount of decurling in a copy sheet.

2. Description of the Related Art

In an electrophotographic application such as xerography, a charge retentive surface is electrostatically charged. A light pattern formed from the original image to be reproduced selectively discharges the charge of a retentive surface. The resulting pattern, a combination of charge and discharge areas on the charge retentive surface, form an electrostatic charge pattern (an electrostatic latent image) conforming to the original image. The latent image is developed by contacting it with a finely divided electrostatically attractable powder referred to as "toner". The toner is held on the image area by electrostatically charging the surface. Thus, a toner image is produced in conformity with a light image of the original beam produced. The toner image may then be transferred to a substrate (e.g., paper), and the toner is fused onto the substrate by passing through a fuser. The substrate with the affixed latent image has some degree of curl to it. The substrate is forwarded through a decurling apparatus to remove the curl of the substrate. Then the substrate is either ejected from the machine to a holding tray or is re-routed through the machine for a second side copy.

The electrophotographic process is well known, and is useful for light lens copying from an original, and printing applications from electronically generated or stored originals, where a charged surface may be discharged in a variety of ways. Ion projection devices where charge is imagewise deposited on a charge retentive surface operate similarly.

The curl of the substrate could affect the proper stacking or correlating of the copy machine output. The curl occurs during the fusing process. In the fuser, heat is applied to the image side of the copy sheet to fuse the toner to the substrate. When the heat is applied, the moisture dries on the one side of the copy sheet. The difference in the moisture level between the fused side and the other side of the copy sheet produces substantial differences in curl. The high moisture content in the copy paper may be due to storage of the paper in a high ambient humidity level or in the copy machine. Differences in the amount of curl will also occur in accordance with the weight of a copy paper.

Prior decurling devices feed individual cut sheets through the decurling mechanisms which are adjustable to compensate for varying sheet curls depending upon ambient conditions and sheet characteristics. This mechanism must be manually adjusted each time a different type of copy sheet is used. It is difficult to obtain the exact amount of straightening necessary due to the variable curling, from day to day and from the use of various papers in a wide range of paper weight and different curl characteristics.

A typical belt and roller decurler apparatus use a roller to penetrate into a belt to have paper conform to a given radius.

SUMMARY OF THE INVENTION

The present invention is drawn to an improved apparatus and method for adjusting the decurling of the substrate in a xerography machine. The invention combines a decurling apparatus having a roller with a small radius which is applied against and penetrates into a belt. The penetration bar roller is adjustable and as it pushes into the belt, more decurling of a copy sheet will occur. A controller determines the amount of decurling that is necessary and controls a driver (a motor) which moves the penetration roller. The penetration roller is either pressed into or away from the decurling belt. A cam shaft is turned by the motor to cause the cams to move the penetration roller. Although the controller stores the information on the cam location, a home sensor is required to indicate home position. The cam shaft is returned to home position before adjusting the penetration roller to a new level of decurling.

Another preferred embodiment of the present invention uses an encoder disk with holes at the circumferential edge. The encoder disk is attached to the cam shaft. An IR sensor detects the number of holes passing which directly relates to the amount of penetration into the belt by the penetration roller.

BRIEF DESCRIPTION OF THE DRAWINGS

For a better understanding of the invention and further features thereof, reference is made to the following detailed description of the invention to be read in connection with the accompanying drawings, wherein.

DETAILED DESCRIPTION OF THE PREFERRED EMBODIMENTS

Figure 1:
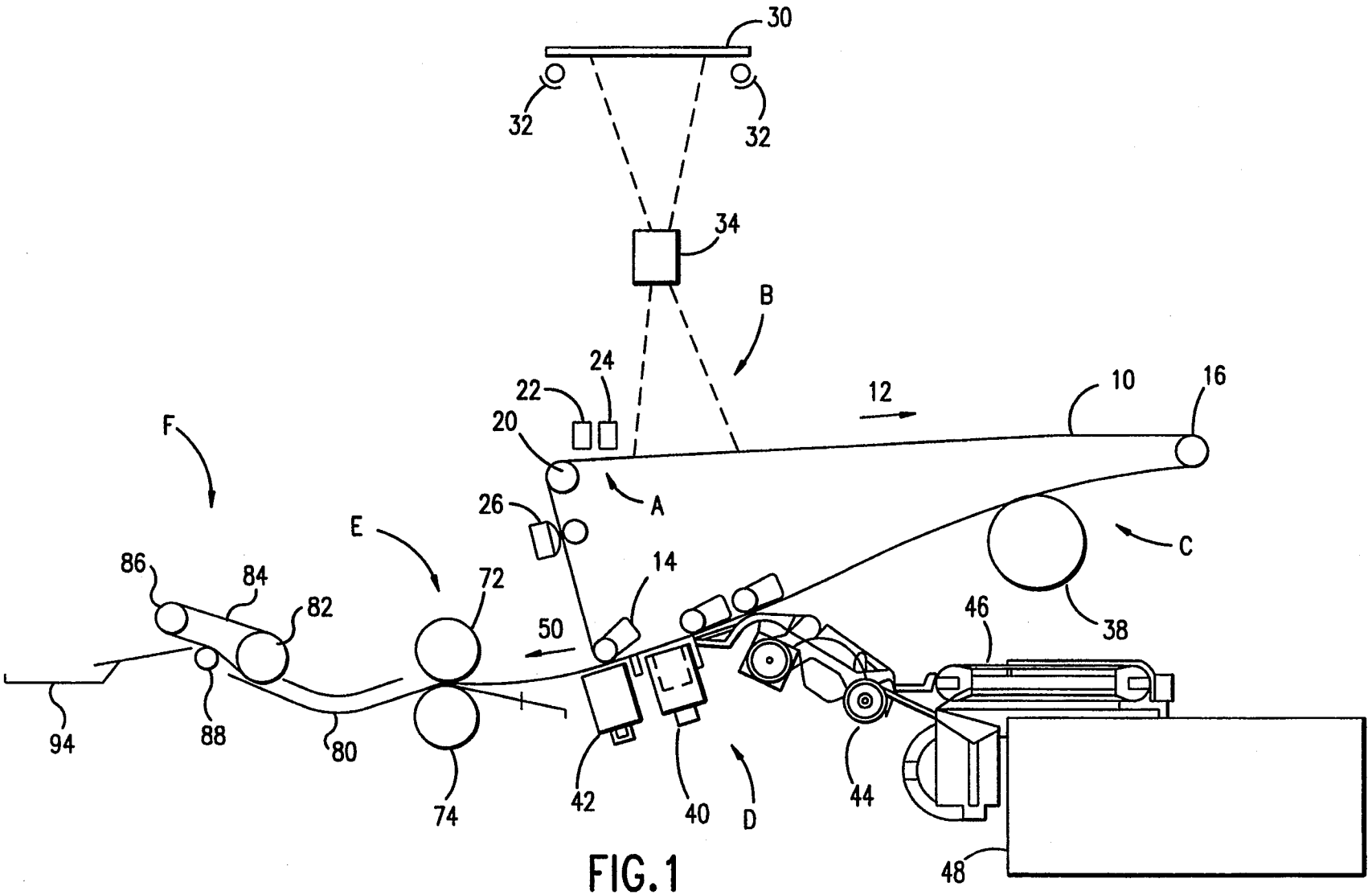
FIG. 1 illustrates the general features of a xerographic reproduction machine.

Referring now to the drawings, where the showings are for the purpose of describing a preferred embodiment of the invention and not limiting same, the various processing stations employed in the reproduction machine illustrated in FIG. 1 will be described only briefly. It will no doubt be appreciated that the various processing elements also find advantageous use in electrophotographic printing applications from an electronically stored original.

Accordingly, a reproduction machine in which the present invention finds advantageous use utilizes a photoreceptor belt 10. Belt 10 is entrained about rollers 14, 16, and 20 to support and maintain tension on the belt 10. The belt 10 move in the direction of arrow 12 to first pass charging station A. At charging station A, a pair of corona devices 22 and 24 charge photoreceptor belt 10 to relatively high, substantially uniform negative potential.

At exposure station B, an original document is positioned face down in a transparent platen 30 for illumination with flash lamps 32. Light rays reflected from the original document are reflected through a lens 34 and projects it onto a charge portion of a photoreceptor belt 10 to selectively dissipate the charge thereon. This records electrostatic latent image on the belt which corresponds to an informational area contained within the original document.

The belt 10 advances the latent image to development station C where a magnetic brush developer unit 38 advances the developer mix (i.e., toner and carrier granules) into contact with electrostatic latent image. The latent image attracts the toner particles from the carrier granules thereby forming toner powder images on the photoreceptor belt 10.

Belt 10 then advances the developed latent image to transfer station D. A sheet of support material such as a copy sheet (paper) is moved from a supply tray 48 to the transfer station by conveyor 46 and rollers 44. The copy sheets are charged by transfer corona device 40 to the proper potential so that it is tacked to the photoreceptor belt 10 and a toner powder image is attracted from the photoreceptor belt 10 to the copy sheet. After transfer, a detack corotron 42 charges the copy sheet to the opposite plurality to detack the copy sheet from the belt 10. The belt advances to cleaning module 26 to remove excess toner from the belt 10.

After transfer, the copy sheet continues to move in the direction of the arrow 50 to fusing station E, where a fuser assembly permanently affixes the transfer toner powder images to the copy sheets. Preferably, the fuser assembly includes a heated fuser roller 72 adapted to be pressure engaged with a pressure roller 74.

After fusing, copy sheets bearing fused images are directed toward the decurling station F through chute 80. Chute 80 guides the advancing sheet toward the decurler belt 84, which is stretched around decurler rollers 82 and 86. The elasticity of the decurler belt 84 maintains the tension around the rollers. Roller 82 is usually larger than roller 86 because a gradual angle (larger roller 82) is needed to grip the copy sheet on the upstream side of the decurler apparatus. In order to facilitate the removal of the copy sheet, a smaller roller 86 is used of the downstream side of the decurler apparatus. A penetration roller 88 is pressed into the decurler belt 84 to decurl the copy sheet. The penetration roller 88 is manually adjusted in the prior art to effect the proper decurl of the copy sheet. After the copy sheet is passed between the penetration roller 88 and the decurler belt 84, the copy sheet is ejected across chute 92 toward the sorter 94. In the sorter, the copy sheet is sent to a catch tray where it is correlated. In the alternative, the copy sheet may be advanced to a duplex tray (not shown) from which it will be returned to the processor for receiving a second side copy.

Figure 2:
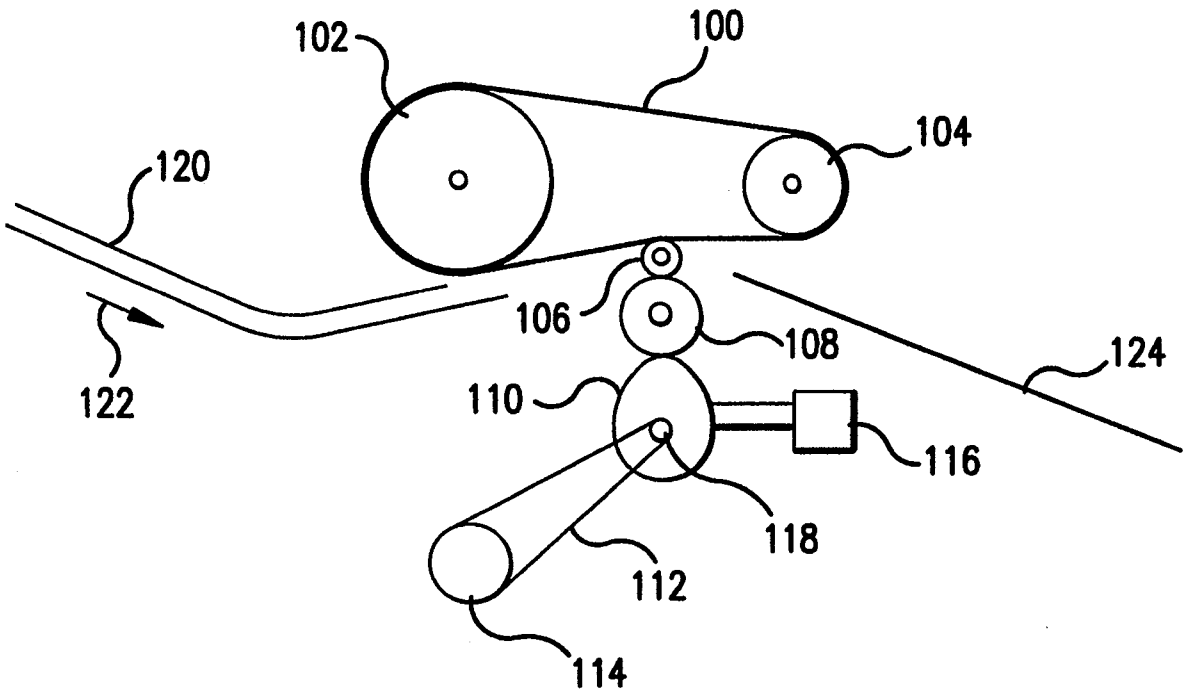
FIG. 2 shows a side view of a decurler apparatus of the present invention.

In accordance with the first preferred embodiment of the invention and with reference to FIG. 2, an automatic decurler apparatus is shown. A chute 120 is used to move the paper from the fuser station toward the decurler apparatus. The decurler belt 100 is wrapped around a decurler belt roller 102 and 104. Tension is maintained by the elasticity of the belt 100.

A penetration roller 106 is pressed against and into the outer surface of the decurler belt 100 at a position parallel to the decurler belt roller 102 and the decurler tension belt roller 104. The copy sheet will pass between the penetration roller 106 and the decurler belt 100. The penetration roller 106 is a small diameter steel rod which is supported at each end. The center section of the penetration roller 106 tends to flex outwardly in the middle section due to the pressure applied by the flexible decurler belt 100. In order to avoid this flexing of the penetration roller 106, which has an adverse effect on the decurling of copy sheets, a support shaft 108 is used. The support shaft 108 extends the full length of the penetration roller 106 to prevent the penetration roll from sagging in the center.

A cam shaft 118 has a cam 110 attached near each end. The cams 110 are in contact with the ends of the support shaft 108. The cams 110 have an angular displacement which presses the support shaft 108 and penetration roller 106 into the decurler belt 100 to cause more or less decurling of the copy sheet. A motor shaft 114 is connected to a motor (not shown) and a timing belt 112 which moves the cam 110. Although software stores the position of the cam in relation to the support shaft, a home sensor 116 is required to indicate home position. A post-decurler guide 124 assists the decurled copy paper toward the sorter (not shown).

In order to control the movement of the cams 110, several types of motors can be used. In the first preferred embodiment, a stepper motor is used to cause an "infinite step" decurling apparatus. The stepper motor moves the motor shaft 114 a countable number of steps to position the cam 110, which incrementally moves the penetration roller 106 relative to the decurler belt 100. The controller (not shown) energizes the motor for a certain number of steps which causes the cam 110 to rotate a predetermined angular amount. The penetration roller 106 is forced into the decurler belt 100 an amount associated with the amount of rotation of the cam 110. In order to determine orientation, the cam 110 and the cam shaft 118 are returned to the home position by using the home sensor 116.

The controller in the electrophotographic machine determines if the copy sheet will have too much curl. There are several factors which the controller may consider before determining the amount of decurl necessary in order to produce flat copy sheets. First, the weight, sheen and fiber direction (grain) of the paper are considered. Also, the copy sheet may be a transparency which has different decurl properties. Second, the amount of toner on the paper is a factor. For example, a copy sheet with toner on both sides requires a different amount of decurling than a copy sheet with toner on only one side. Also, the amount of toner, i.e., the area coverage, on the copy sheet effects the amount of decurling necessary. Third, the conditions of the surrounding atmosphere are also taken into consideration. The curling characteristics of the substrate are affected by the ambient temperature of the surroundings, the heat generated by the machine, and the humidity of the air.

The controller can be activated by a switch which may simply be a curl or decurl function. In the alternative, the switch may have a number of levels which correspond to the depth of the penetration roller 106 into belt 100. The controller could also be run by software that automatically adjusts the decurl without any operator intervention.

The controller determines the amount of pressure needed between the penetration roller 106 and the decurler belt 100 in order to decurl the copy sheets. The controller energizes the motor so that a predetermined number of steps are performed so that the penetration roller 106 is in the correct position. The copy sheets would be decurled by passing them between the decurler belt 100 and the penetration roller 106. The copy sheets would then continue in the feed direction to the sorter.

Figure 3:
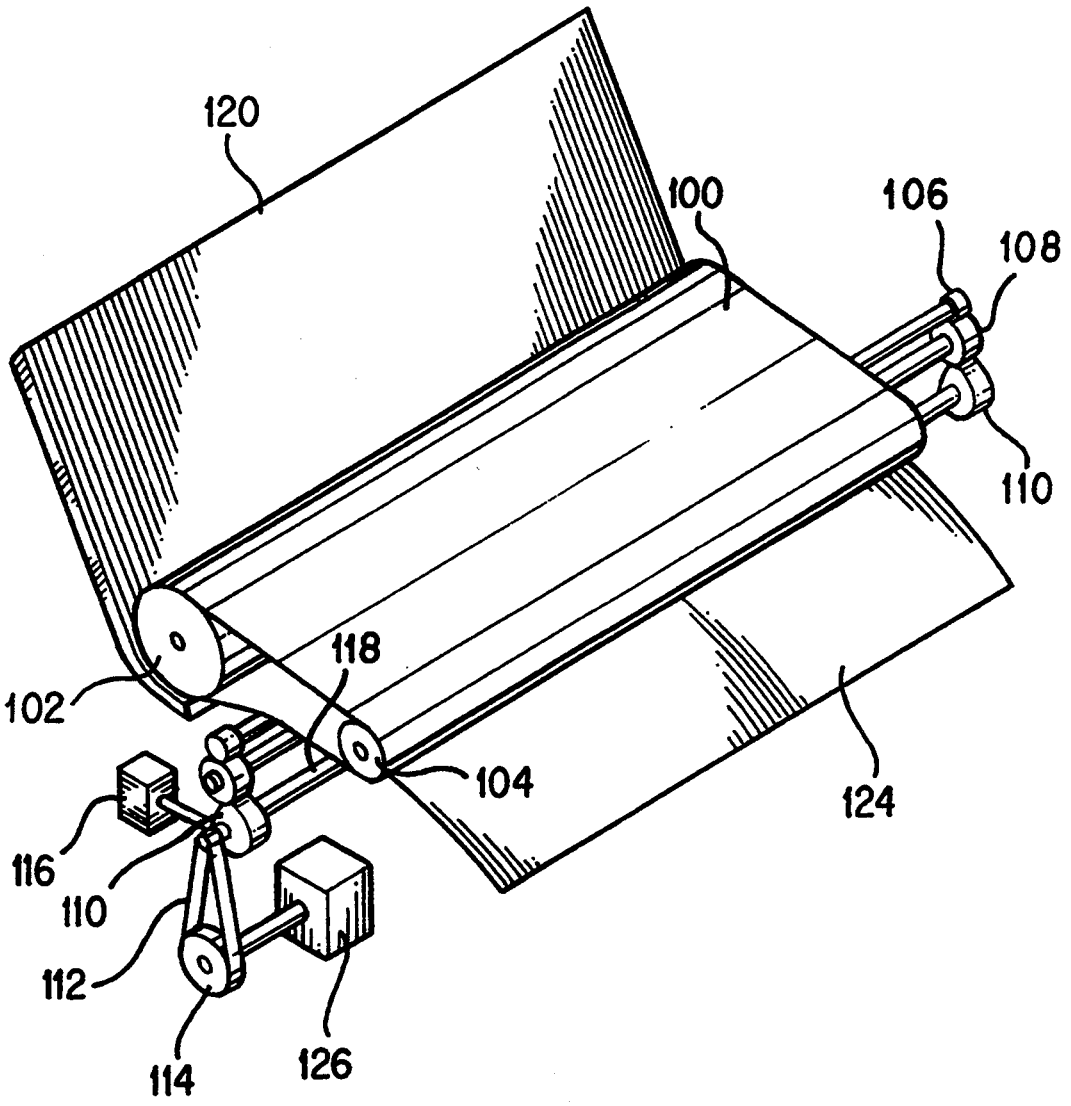
FIG. 3 shows an isometric view of a decurler apparatus of the first preferred embodiment.

FIG. 3 is an isometric view of the first preferred embodiment. A cam 110 is attached to each end of the cam shaft 118. The motor 126 moves the motor shaft 114 by a specific amount in order to move the cams 110. A cam 110 is attached to each end of the cam shaft 118 in the first preferred embodiment.

Figure 4:
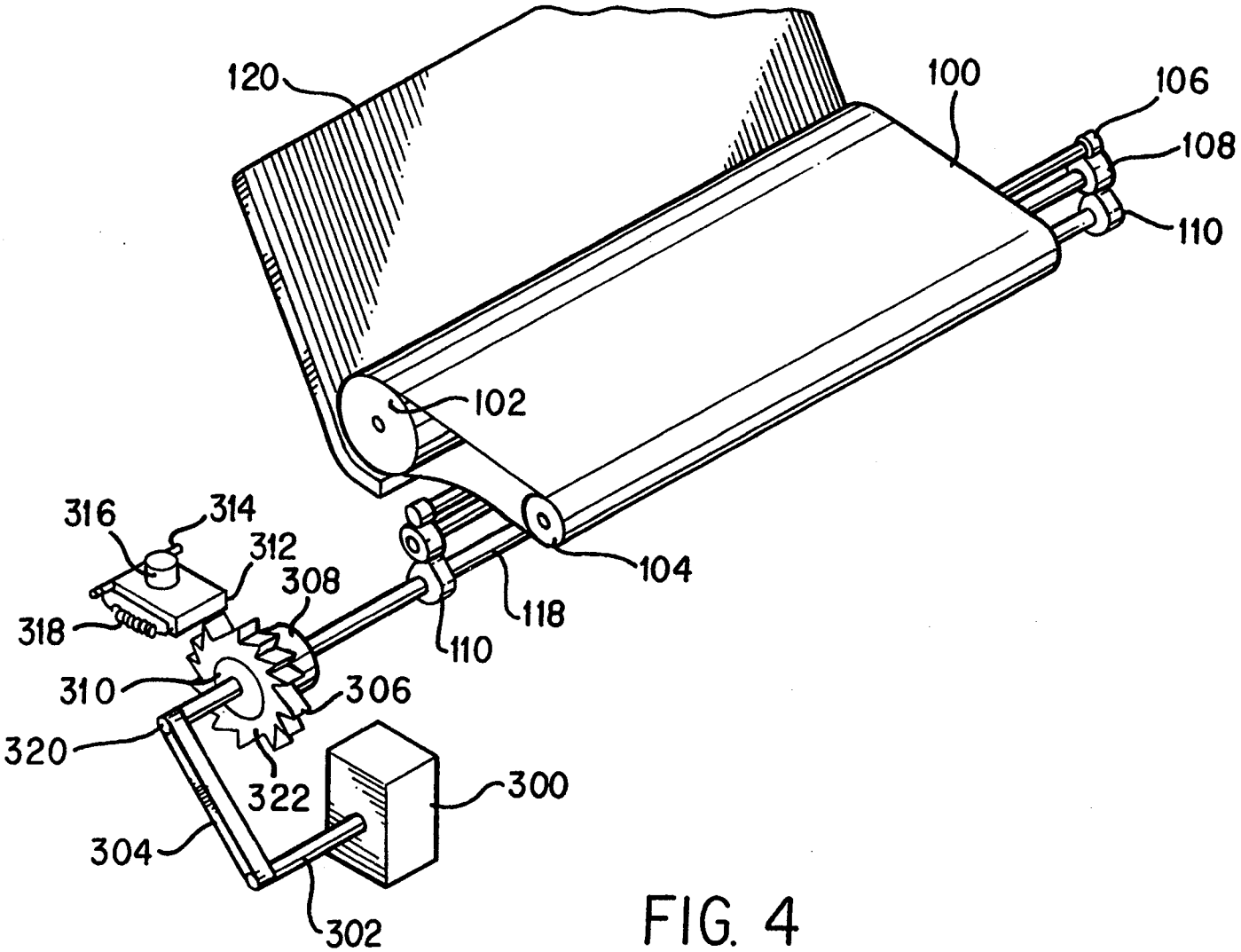
FIG. 4 shows an isometric view of a second preferred embodiment using an N-step clutch apparatus.

A second preferred embodiment of the invention is shown in FIG. 4. This embodiment is similar to the first preferred embodiment described above. Instead of using the "infinite step" motor, an N-step clutch apparatus is used. The clutch can be operated using the power takeoff from the fuser drive or have a separate motor 300. A motor drive shaft 302 rotates a clutch input shaft 320 by using a timing belt 304. A wrap spring 310 connects the clutch input 320 to the clutch output 322. There are N steps 306 on the clutch output 322 and each step equates to a specific penetration of the penetration roller 106 into the decurler belt 100. Shaft 308, which is attached to cam shaft 118, is attached to the clutch output 322.

The solenoid 116 is energized and attracts a solenoid pawl 312 which pivots on pivot rod 314. When the solenoid pawl 312 is disengaged from the clutch output 322, the clutch output will move in a clockwise direction. When the solenoid 116 is turned off, the solenoid pawl 312 is allowed to engage the clutch output 322. Spring 318 can be used to pull the solenoid pawl 312 toward the clutch output 322. The solenoid pawl 312 stops the rotation of the clutch output 322 by engaging one of the N steps 306. Once the rotation of the clutch output 322 and the coupled cams 110 is completed, then a copy sheet can pass between the penetration roller 106 and the decurler belt 100 as in the previous embodiment.

Figure 5:
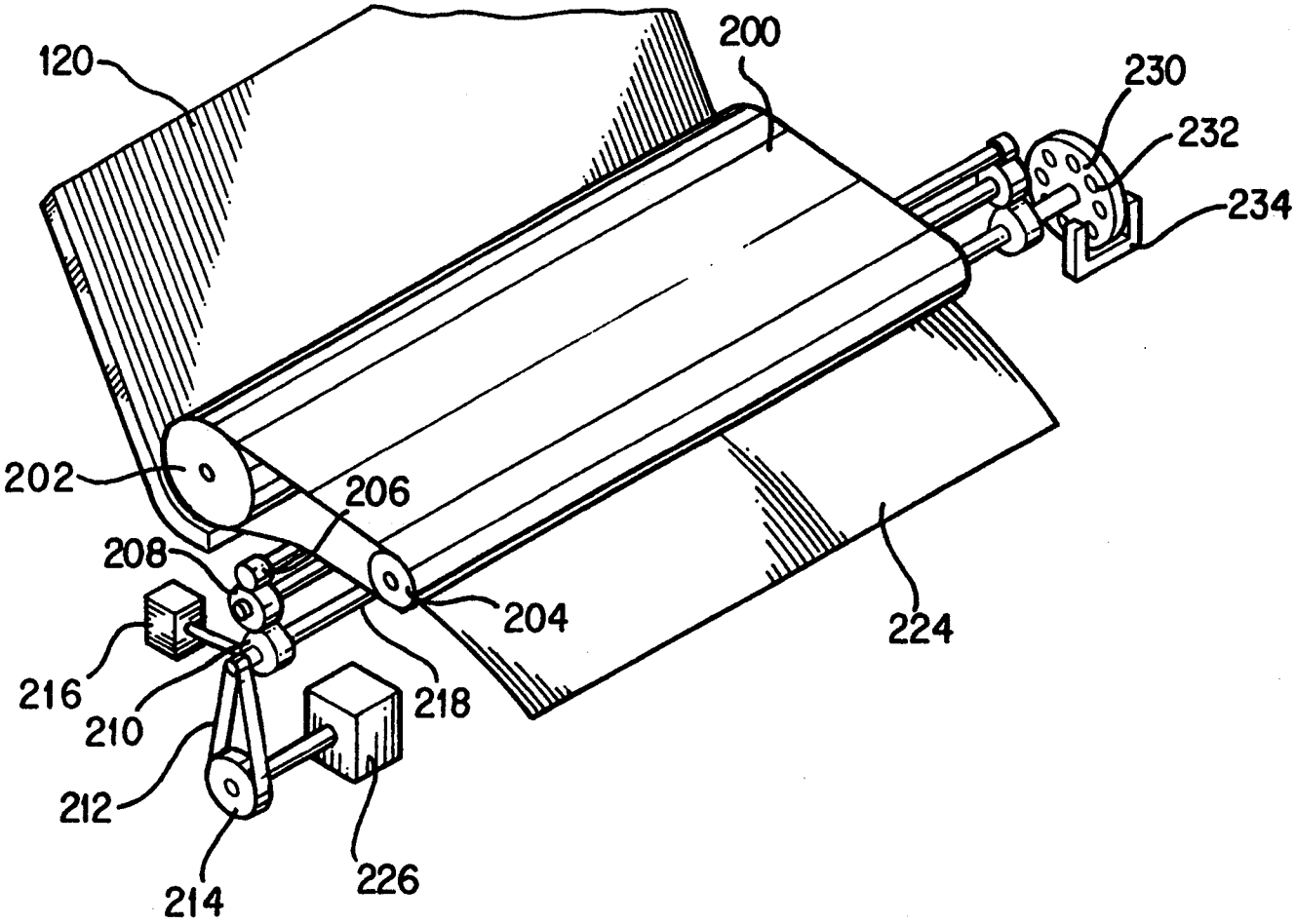
FIG. 5 shows an isometric view of a third preferred embodiment using an encoder disk.

A third preferred embodiment is shown in FIG. 5. This is a isometric view of the decurler apparatus similar to FIG. 3, but several features have been added. An encoder disk 230, which has equally spaced holes 232 around the circumference of the encoder disk, is attached to the cam 210. A cam 210 is attached to each end of a cam shaft 218. Since the encoder disk 230 is attached to the cam shaft 218, it axially moves the same amount as the cams 210 and passes the IR sensor 234. An infrared light (not shown) is sent through the holes 232 and sensed on the other side by the IR sensor 234. When this occurs, a signal is sent to the controller (not shown). The motor shaft 214 of a DC motor 226 drives the cam shaft 218 by using a belt 212. The holes 232 in the encoder disk 230 correspond to given displacements of the cams 210 and a given penetration depth of the penetration roller 206.

At the appropriate time, the motor 226 starts and continues until the correct number of holes 232 have been sensed by the IR sensor 234. Once the penetration roller 206 is in the proper position, the motor 226 shuts off and the cam shaft 218 remains in that position. The controller can release the penetration roller 206 and start at the home position by using the home sensor 216.

Although the invention has been described and illustrated with particularity, it is intended to be illustrative of preferred embodiments. It is understood that the present disclosure has been made by way of example only. Numerous changes in the combination and arrangements of the parts and features can be made by those skilled in the art without departing from the spirit and scope of the invention, as hereinafter claims.

What is claimed is:

1. A sheet decurler assembly in an electrophotographic device for decurling a substrate, the substrate having a curl after passing through a fuser for affixing a latent image to the substrate, the sheet decurler assembly comprising:

a decurler belt for receiving a curled substrate from the fuser, the decurler belt being supported by at least two belt rollers and wrapped therearound;

a penetration roller disposed adjacent to the decurler belt for penetrating into an outer surface of the decurler belt by a desired degree of penetration to form a nip therebetween, the penetration roller being parallel with the at least two belt rollers, the desired degree of penetration of the penetration roller relative to the belt inducing a corresponding desired reverse curl on the substrate passage through the nip;

a cam shaft having at least two cams contacting the penetration roller such that rotation of the cam shaft to an angular position rotates the cam to position the penetration roller into the decurler belt by the desired degree of penetration; and a controller for controlling the angular position of the cam shaft in response to the desired reverse curl, the controller comprising an encoder disk with equally spaced holes near the circumferential edge of the encoder disk and attached to the cam shaft, and an infrared sensor cooperating with the encoder disk to detect the number of holes passing the sensor upon rotation of the cam shaft, the number representing the degree of penetration of the penetration roller.

2. The sheet decurler assembly in claim 1, wherein a support shaft is between the cam shaft and the penetration roller to support the penetration roller.

3. The sheet decurler assembly in claim 1, wherein a chute is used to direct the substrate from the fuser to the sheet decurler assembly.

4. The sheet decurler assembly in claim 1, wherein a home sensor is attached to the cam to determine a home position.

5. A sheet decurler assembly in an electrophotographic device for decurling a substrate, the substrate having a curl after passing through a fuser for affixing a latent image to the substrate the sheet decurler assembly comprising:

a decurler belt for receiving curled substrate from the fuser, the decurler belt being supported at least two belt rollers and wrapped therearound;

a penetration roller disposed adjacent to the decurler belt for penetrating into an outer surface of the decurler belt by a desired degree of penetration to form a nip therebetween, the penetration roller being parallel with the at least two belt rollers, the desired degree of penetration of the penetration roller relative to the belt inducing a corresponding desired reverse curl on the substrate passing through the nip;

a cam shaft having at least two cams contacting the penetration roller such that rotation of the cam shaft to an angular position rotates the cam to position the penetration roller into the decurler belt by the desired degree of penetration; and a controller for controlling the angular position of the cam shaft in response to the desired reverse curl, the controller comprising an electrically driven wrap spring clutch with N stops so that each stop corresponds to a given point on the cam and a predetermined penetration of the penetration roller.

6. The sheet decurler assembly in claim 5, wherein the controller includes an infinite step motor which counts steps and positions the cam shaft at the angular position corresponding to the desired degree of penetration.

7. The sheet decurler assembly in claim 5, wherein a home sensor is attached to the cam to determine a home position.

8. A sheet decurler assembly in an electrophotographic device for decurling a substrate, the substrate having a curl after passing through a fuser for affixing a latent image to the substrate the sheet decurler assembly comprising:

sheet transfer means for receiving curled substrate from the fuser;

penetration means for penetrating into the sheet transfer means a predetermined amount to induce a desired amount of reverse curl on the substrate passing between a nip formed by the penetration means and the sheet transfer means; and controlling means for controlling the amount of penetration of the penetration means into the sheet transfer means in response to the desired amount of reverse curl, the controlling means comprising a cam attached to a shaft that is coupled to the penetration means, an encoder disk with equally spaced holes near the circumferential edge of the encoder disk attached to the cam shaft, and an infrared sensor cooperating with the encoder disk to detect the number of holes passing the sensor upon rotation of the cam shaft, the cain shaft being moved by a motor which moves the encoder disk until the infrared sensor detects a predetermined number of holes, wherein an angular movement of the cam causes a linear replacement of the penetration means relative to the sheet transfer means.

9. The sheet decurler assembly in claim 8, wherein the sheet transfer means is a belt wrapped around at least two rollers to support and apply tension to the belt.

10. The sheet decurler assembly in claim 8, wherein the angular movement of the cam is performed by an infinite step motor which counts steps and positions the cam shaft at an angular position corresponding to the desired penetration.

11. The sheet decurler assembly in claim 8, wherein the penetration means is a roller.

12. The sheet decurler assembly in claim 11, wherein the support shaft supports the roller and is located between a cam shaft and the roller.

13. The sheet decurler assembly in claim 8, wherein a chute is used to direct the substrate from the fuser to the sheet decurler assembly.

14. The sheet decurler assembly in claim 8, wherein a home sensor is attached to the cam to determine a home position.

15. A sheet decurler assembly in an electrophotographic device for decurling a substrate, the substrate having a curl after passing through a fuser for affixing a latent image to the substrate, the sheet decurler assembly comprising:

sheet transfer means receiving curled substrate from the fuser;

penetration means for penetrating into the sheet transfer means a predetermined amount to induce a desired amount of reverse curl on the substrate passing between a nip formed by the penetration means and the sheet transfer means; and controlling means for controlling the amount of penetration of the penetration means into the sheet transfer means in response to the desired amount of reverse curl, the controlling means comprising a cam attached to a shaft that is coupled to the penetration means, and an electrically driven wrap spring clutch with N stops so that each stop corresponds to a given point on the cam and a predetermined penetration of the penetration means, wherein an angular movement of the cam causes a linear displacement of the penetration means relative to the sheet transfer means.

16. The sheet decurler assembly in claim 15, wherein a home sensor is attached to the cam to determine a home position.

17. A method of automatically decurling a substrate having a curl after passing through a fuser for affixing a latent image to the substrate, the method comprising the steps of:

determining a desired amount of decurl necessary to produce a flat substrate based on at least one of the characteristics of the substrate, toners used to produce the latent image, operating conditions of a machine, and surrounding atmospheric conditions;

adjusting a penetration roller relative to a decurler belt a predetermined amount to induce a reverse curl on the substrate, the penetration roller being coupled to a cam shaft such that an angular movement of the cam shaft causes a linear displacement of the penetration roller; and forwarding the substrate between a nip formed between the penetration roller and the decurler belt;

wherein the step of adjusting the penetration roller is performed by using a wrap spring clutch attached to a motor where the clutch moves the cam shaft coupled to the penetration roller.

18. A method of automatically decurling a substrate having a curl after passing through a fuser for affixing a latent image to the substrate the method comprising the steps of:

determining a desired amount of decurl necessary to produce a flat substrate based on at least one of the characteristics of the substrate, toners used to produce the latent image, operating conditions of a machine, and surrounding atmospheric conditions;

adjusting a penetration roller relative to a decurler belt a predetermined amount to induce a reverse curl on the substrate, the penetration roller being coupled to a cam shaft such that an angular movement of the cam shaft causes a linear displacement of the penetration roller; and forwarding the substrate between a nip formed between the penetration roller and the decurler belt;

wherein the step of adjusting the penetration roller is performed using an encoder disk with equally spaced holes near the circumferential edge of the encoder disk, the encoder disk being attached to the rotating cam shaft, an infrared sensor detecting the number of holes which have passed upon rotation of the cam shaft, and wherein the cam shaft is moved by a motor which moves the encoder disk so that the infrared sensor detects a predetermined number of holes.

19. The method of claim 18, wherein the step of adjusting the penetration roller is performed by using a stepper motor driving the cam shaft which displaces the penetration roller a linear amount depending on the angular movement of the cam shaft.

* * * * *